US005296057A

United States Patent [19]

Baba et al.

[11] Patent Number: 5,296,057

[45] Date of Patent: Mar. 22, 1994

[54] HIGH ABRASION RESISTANT ALUMINUM BRONZE ALLOY, AND SLIDING MEMBERS USING SAME

[75] Inventors: Noboru Baba, Hitachioota; Katsuhiko Komuro, Hitachi; Masateru Suwa, Ibaraki; Mitsuo Chigasaki, Hitachi; Yozo Kumagai, Katsuta; Mashayoshi Kainuma, Mito; Masaru Sakakura, Katsuta, all of Japan

[73] Assignee: Hitachi, Ltd., Tokyo, Japan

[21] Appl. No.: 947,923

[22] Filed: Sep. 21, 1992

[30] Foreign Application Priority Data

Sep. 20, 1991 [JP] Japan ..... 3-241457

[51] Int. Cl.[5] ..... C22C 9/01

[52] U.S. Cl. ..... 148/436; 420/489; 420/490

[58] Field of Search ..... 148/436; 420/489, 490

[56] References Cited

U.S. PATENT DOCUMENTS 4,025,336 5/1977 Suwa et al. ..... 148/436

FOREIGN PATENT DOCUMENTS 530866 9/1956 Canada ..... 420/489
44-28789 11/1969 Japan ..... 420/489
49-37685 10/1974 Japan ..... 420/489
60-39141 2/1985 Japan ..... 420/489
2075058 11/1981 United Kingdom ..... 420/489

*Primary Examiner*—Richard H. Dean
*Assistant Examiner*—Sikyin Ip
*Attorney, Agent, or Firm*—Antonelli, Terry, Stout & Kraus

[57] ABSTRACT

The object of the present invention is to provide an abrasion resistant aluminum bronze alloy for sliding members of various industrial machines.

The abrasion resistant aluminum bronze alloy consists of Al: 7–12%, Mn: 1.5–5.5%, Si: 0.45–2.7%, respectively in weight, and the rest is substantially Cu, wherein metallic compound of Mn and Si is dispersed among said alloy structure, and elongation percentage is at least 5%.

The abrasion resistant aluminum bronze alloy is superior to conventional aluminum bronze alloy (JIS-ALBC2) in seizure resistance and abrasion resistance by more than two times.

10 Claims, 3 Drawing Sheets

HIGH ABRASION RESISTANT ALUMINUM BRONZE ALLOY, AND SLIDING MEMBERS USING SAME

BACKGROUND OF THE INVENTION

The present invention relates to high abrasion resistant aluminum bronze alloy, especially aluminum bronze alloy preferable as material for sliding members which slide with sliding portions of mechanical structure steel, and tool steel etc. in various industrial machines such as hydraulic machines and machine tools etc.

Generally speaking, copper alloy has been used as material for sliding members such as, for example, gears, bearings, worm wheels etc. in various industrial machines. Because, if the sliding members are composed from the same material as machine structural steel such as carbon steel, Cr-Mo steel, and case hardening steel etc. or as tool steel such as bearing steel, and high speed steel etc., the abrasion increases by wearing with metal of same kind. Farther, various copper alloys are respectively used depending on characteristics required for each member.

As an example, high tensile brass and aluminum bronze are used for gears and worm wheels which are required for hardness and mechanical strength, and bronze and phosphor bronze are used for bearings which is required for anti-seizing and anti-galling characteristics. Farther, depending on requirement for high strength and high abrasion resistance, Cu-Zn alloy group in which Mn-Si compounds crystallize and are dispersed (JP No. 882216), and Cu-Al alloy group in which Fe-Si compounds crystallize and are dispersed (JP No. 1189793) are proposed. However, the above described alloys are still not sufficient as abrasion resistant alloys, and appearance of farther high performance alloy is expected.

Besides, very hard abrasion resistant aluminum bronze alloy (JP No. 1374020) is proposed as material for cold work dies for active metals such as stainless steel and titanium etc. Because of containing hyper-eutectoid aluminum (more than 12%) and having high Mn composition (Mn: more than 6%), the alloy has small elongation (less than 3% of elongation percentage) as for a mechanical property and is not suitable as sliding members for industrial machines.

SUMMARY OF THE INVENTION

One of the objects of the present invention is to provide aluminum bronze alloy having high toughness (elongation percentage more than 5%) and high abrasion resistance.

Other object of the present invention is to provide sliding members having high abrasion resistance as sliding members for various industrial machines.

Gist of the present invention to realize the above described objects is the high abrasion resistant aluminum bronze alloy characterized in substantially consisting of Al: 7–12%, Mn: 1.5–5.5%, Si: 0.45–2.7%, impurities at most 0.5% in weight respectively, and the rest is substantially of copper, and that metallic compounds of Mn and Si are dispersed, of which high toughness and high abrasion resistance are realized by dispersed crystallization of Mn-Si compounds in Cu-Al group alloy.

Especially, ratio of Mn and Si is preferably in 1–3.25. Farther, in the above described alloy, Zn: at most 2%, Pb: at most 1%, at least one of Cr, V, Ti, and Zr: at most 1%, total, and impurities (mainly Fe and Ni): at most 0.5%, can be included.

Generally, Cu-Al group alloy is called aluminum bronze and has a preferable property against sliding abrasion, but, on the contrary, has a disadvantage to cause galling easily because of its stickiness. However, the alloy having the composition of the present invention can overcome the disadvantage. The reason is that Mn-Si compound crystallized in solid solution of the Cu-Al group alloy has high resistance against abrasion.

In order to make the Cu-Al group alloy exhibit the above described effects of Mn-Si compound effectively, it is important to consider the following points.

1. The Mn-Si compound crystallizes out of the solid solution during solidifying process of molten Cu alloy, but the abrasion resistance is improved when the Mn-Si compound is in a region of hyper-eutectic composition (a region wherein the Mn-Si compound exists as primary crystals).

2. As elongation of the alloy decreases depending on increment of quality of Mn-Si compound, additive quantity of Mn and Si for obtaining the region of the above described hyper-eutectic composition must be small as possible.

3. The Mn-Si compound crystallizes out of the Cu-Al group alloy in a rod-like form (compound structure: hexagonal of $Mn_5Si_3$), but in order to prevent decreasing of elongation of the alloy, it is preferable that the Mn-Si compound crystallizes in massive form and, then, the Mn-Si compound in massive form is refined.

Next, composition of the alloy relating to the present invention and its quantitative range are explained.

(1) Al

Content of Al relates to strength of the alloy, and a range of 7–12% is preferable. If Al content is less than 7%, aimed strength of 40 kgf/mm$^2$ of the as-cast alloy as a member of machine can not be satisfied, and if it is more than 12%, the alloy becomes brittle because of precipitation of $\gamma_2$ phase and not preferable for practical use as a member of machine. Therefore, the content of 8–11%, especially 8.0–9.0, is preferable.

(2) Mn and Si

Mn and Si are dispersed homogeneously in the alloy structure as Mn-Si compound, and are indispensable elements for improvement of abrasion resistance. Especially, the compound crystallized out of the Cu-Al solid solution was revealed to have a structure close to $Mn_5Si_3$ in stoichiometric composition from an analytical result by X-ray microanalyser. The compound contains Mn and Si in a ratio in weight of Mn:Si $\approx$ 3.25:1.

In order to improve abrasion resistance, Mn-Si compound preferably crystallizes as primary crystalline. In a case of Cu-Al alloy, necessary quantity of Mn-Si compound is at least 2% and is relatively smaller than necessary quantity of Mn-Si compound in pure copper, Cu-Sn and Cu-Zn of respective 24%, 10%, and 3%. In the present invention, preferable content of Mn and Si are respectively 1.5–5.5% and 0.45–2.7%. Especially, in view of both tensile strength and abrasion resistance, preferable content of Mn and Si are respectively 3.8–5.4% and 1.0–2.0.

The abrasion resistance increases with increment of quantity of Mn-Si compound, but when the quantity of Mn-Si compound exceeds 7.2%, the alloy becomes impossible to achieve aimed elongation of 5%. Accordingly, when Mn is contained 5.5%, content of Si can be at most 1.7%. However, containing at most 1% of excessive quantity of Si than necessary quantity of Si for formation of Mn-Si compound (stoichiometric composition of $Mn_5Si_3$)effects advantageously in improvement of both abrasion resistance and strength. Therefore, in the present invention, Si can be contained at most 2.7%.

Farther, in aspect of formation of Mn-Si compound and quantity of Si in the Cu-Al solid solution, composition ratio of Mn and Si, Mn/Si, is more preferably 2.0–3.0 than 1–3.25. Especially, as quantity of Si in the solid solution decreases elongation percentage, calculated value with an assumption that all of Si contributes formation of $Mn_5Si_3$ and excess Si is occluded in solid solution must be at most 1%. Especially, 0.01–0.6% is preferable, 0.1–0.6% is more preferable, and 0.3–0.5% is most preferable.

(3) Pb

Addition of Pb improves seizure resistance and machinability, especially addition of Pb is effective for certain keeping of abrasion resistance under a condition when lack of lubricating oil is often happened. Quantity of the Pb addition is enough at most 1%, and addition of Pb more than 1% will cause decreasing of mechanical strength of the alloy. Accordingly, a range 0.2–0.6 is preferable.

(4) Zn

Zn has a degassing effect from molten metal at melting operation, and other effect to improve fluidity of the molten metal at casting operation. Farther, Zn has an effect to improve conformability under sliding condition of the alloy, but content of Zn exceeding 2% causes deterioration of sliding characteristics. Accordingly, a range of 0.5–1.5% is preferable.

(5) Cr, V, Ti, and Zr

Cr, V, Ti, and Zr form compounds (silicides) with Si. These elements have an effect to increase strength, and, moreover, Cr and V have an effect to refine the Mn-Si compound. But, when sum of the above described elements exceeds 1%, an effect to decrease toughness is caused. A range of 0.05–0.5 is preferable.

(6) Fe and Ni

Content of Fe and Ni as impurities are allowable at most 0.5%. Especially, Fe has an effect to be solved into Mn-Si compound and to refine the compound. However, when content of Fe exceeds the above described allowable quantity, Fe-Si compounds having high melting point are formed and castability is deteriorated. Moreover, as Ni has an effect to suppress formation of Mn-Si compound, less Ni is preferable. Content of Ni even as impurity is preferably 0.01–0.1%.

The aluminum bronze alloy relating to the present invention is manufactured by melting and casting method as same as general aluminum bronze alloys. However, in case of melting method under atmospheric condition, gases such as oxygen and hydrogen etc. are included into the molten metal, casting is performed after eliminating of slag and bubbling of the molten metal for degassing with nitrogen or mixed gas of nitrogen and fluorides (for example, $N_2$+NaF gas). In accordance with the above described method, casting having no casting defects can be obtained.

Besides, forging, farther extruding after the casting are effective, because the crystallized Mn-Si compound particles are refined by the above described manufacturing, and semi-manufactured products can be obtained. Size of the Mn-Si compound particle in the cast alloy depends mainly on cooling speed in a range over the solidification completion temperature, and the particle size has a trend to becomes larger when the cooling speed is slower.

Farther, the alloy relating to the present invention can be improved in mechanical strength and abrasion resistance etc. by performing heat treatment.

DETAILED DESCRIPTION OF THE EMBODIMENTS

Next the present invention is explained in detail based on embodiments.

EMBODIMENT 1

An example of composition of an alloy obtained by the present invention is shown in Table 1, and mechanical characteristics of the alloy is shown in Table 2.

TABLE 1

| | | Composition of alloy (% in weight) | | | | | | | | | |
|---|---|---|---|---|---|---|---|---|---|---|---|
| | | Al | Mn | Si | Zn | Pb | Cr | Ni | Fe | Cu | Mn/Si |
| Comparative example | No.1 | 8.5 | 0.9 | — | — | — | — | 1.9 | 2.5 | Res. | — |
| | No.2 | 0.72 | 3.7 | 1.5 | Res. | — | — | — | — | 58.8 | 2.5 |
| | No.3 | 12.3 | 2.3 | 0.7 | — | — | — | — | — | Res. | 3.3 |
| Embodiments | No.4 | 8.31 | 4.24 | 1.40 | — | — | — | — | — | Res. | 3.03 |
| | No.5 | 8.01 | 4.60 | 1.43 | 1.23 | — | — | — | — | Res. | 3.22 |
| | No.6 | 8.11 | 4.52 | 1.44 | — | 0.52 | — | — | — | Res. | 3.14 |
| | No.7 | 8.30 | 4.23 | 2.02 | — | — | 0.09 | — | — | Res. | 2.09 |
| | No.8 | 9.01 | 5.36 | 1.77 | — | — | — | — | — | Res. | 3.03 |
| | No.9 | 7.22 | 5.00 | 2.00 | — | — | — | — | — | Res. | 2.50 |

Res: Residue

TABLE 2

| | | Mn/Si | Si in Solid solution (%) | Elongation (%) | Tensile strength (kgf/mm²) | HB Hardness (10/1000) |
|---|---|---|---|---|---|---|
| Comparative example | No.1 | — | — | 20 | 50 | 120 |
| | No.2 | 2.5 | — | 5 | 50 | 150 |
| | No.3 | 3.3 | — | 2.5 | 68 | 245 |
| Embodiment | No.4 | 3.03 | 0.10 | 12 | 48 | 138 |
| | No.5 | 3.22 | 0.02 | 10 | 42 | 134 |
| | No.6 | 3.14 | 0.06 | 6 | 40 | 137 |
| | No.7 | 2.09 | 0.73 | 5 | 51 | 142 |
| | No.8 | 3.03 | 0.13 | 6 | 50 | 172 |
| | No.9 | 2.50 | 0.47 | 25 | 55 | 122 |

Steps of the melting operation were, taking fundamental alloy No. 4 as an example, first melting of copper, subsequent addition of Mn and Si to the molten copper, and final addition of aluminum for obtaining homogeneous molten metal. Subsequently, after eliminating of slag and degassing by bubbling of nitrogen gas into the molten metal, the molten metal was poured into a performed sand mold and solidified. The casting temperature was 1150° C., and an Elema furnace as a melting furnace and graphite crucible were respectively used. Size of the ingot is 50 mm in diameter and 200 mm in length, and weight is about 3 kg.

The alloy in the present embodiment is substantially a Cu-Al alloy wherein Mn-Si compound is homogeneously dispersed. The alloy has a satisfied value as more than 5% in elongation for toughness which is required for sliding members of various industrial machines.

Figure 1:
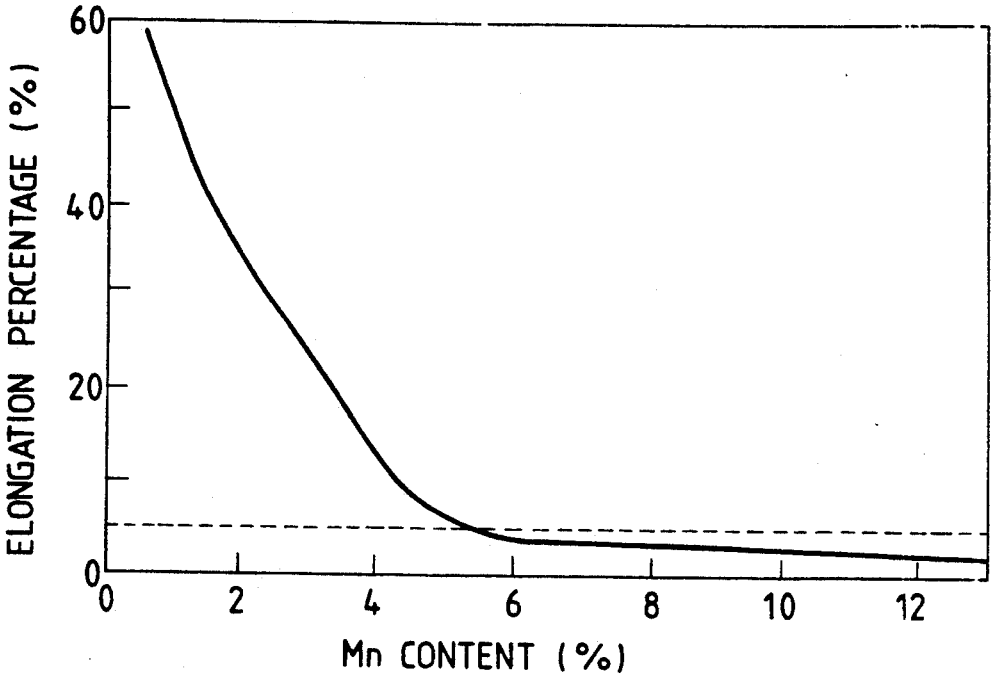
FIG. 1 is a graph showing the relation between mechanical elongation percentage and Mn content in the aluminum bronze alloy obtained by one of the embodiments of the present invention.

In FIG. 1, a relation between Mn content and elongation percentage of the casting, which was one of alloys obtained in the present embodiment, wherein Mn/Si ratio was varied in a range 1.96–3.10 and calculated as $Mn_5Si_3$, quantity of Si in the solid solution was assumed as 0.2%, and added to Cu-9% Al for obtaining dispersedly crystallized Mn-Si compound in the alloy is shown.

As FIG. 1 reveals, elongation decreases as increment of additive amount of Mn increases. Especially, when amount of Mn exceeds 5.5%, elongation percentage becomes not to satisfy 5%, and accordingly, it is necessary to select raw material depending on its characteristics when applying to sliding members.

Figure 2:
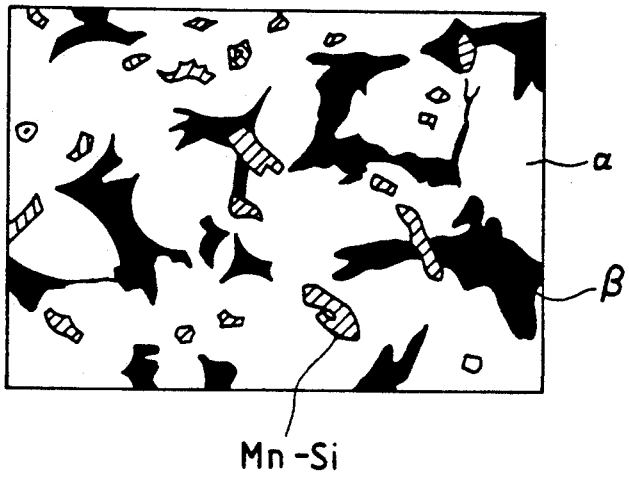
FIG. 2 is a schematic illustration of structure of the aluminum bronze alloy relating to the present invention.

FIG. 2 schematically illustrates microstructure of alloy relating to the present embodiment based on microscopic photograph. In the schematic illustration, white portion indicates $\alpha$ phase and black portion indicates $\beta$ phase, respectively. In the above described two phase matrix, lumps of Mn-Si compound (hatched portion) is uniformly dispersed. As for particle size of the Mn-Si compound, many particles having 20–30 $\mu$m were observed.

Besides, effect of additional elements to the structure has a tendency to increase $\beta$ phase in case of Zn as same as the case of Al, and to make Mn-Si compound finer in case of Cr, V, Ti, and Zr. In case of Pb, no structural change is observed, and Pb exists as scattered particles having a few micrometers in maximum size because of having no solid solubility in the matrix.

EMBODIMENT 2

A plate specimen of 30 mm×30 mm×5 mm was prepared from the ingot obtained by the embodiment 1, and seizure resistance of the alloy under no lubricant was evaluated. The seizure resistance was evaluated by a method including the steps of pushing a bearing steel ball (SUJ-2, 10 mm in diameter) onto the plate specimen, performing a sliding test by reciprocating motion with speed of 8 mm/s, and evaluating seizure resistance based on loading and number of slidings by which friction coefficient rapidly increases (standard: friction coefficient larger than 0.5). The reciprocating motion was 40 mm/stroke, and when any change in friction coefficient was observed after 200 times sliding with 100 g loading, the test was continued with gradually increased loading such as 200 g, and then 300 g.

Figure 3:
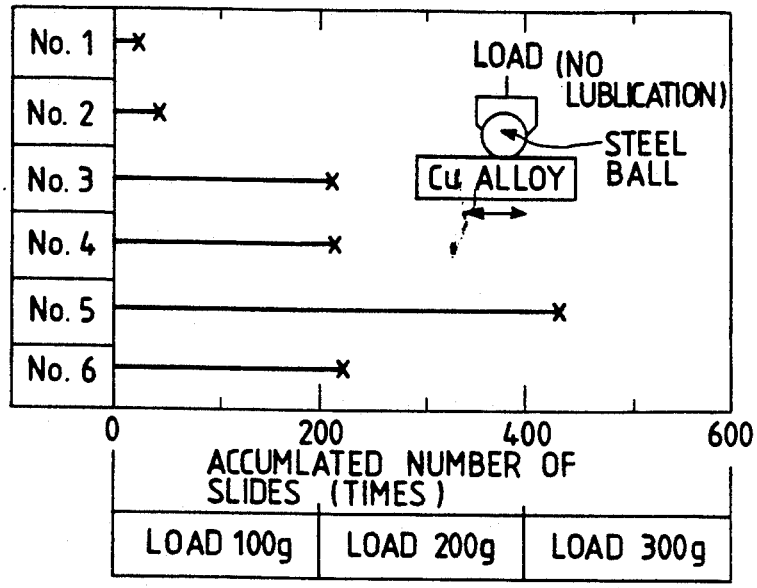
FIG. 3 is a graph showing seizure resistance characteristics obtained by sliding tests under no lubrication.

In FIG. 3, the result of evaluation on seizure resistance of the alloy is shown. Conventional aluminum bronze alloy No. 1 (JIS ALBC2) and abrasion resistant high strength brass No. 2 wherein Mn-Si compound were dispersed in Cu-Zn group alloy caused seizing at initial period of the friction test with 100 g loading. In comparison with the above described comparative examples, the alloys No. 4-7 relating to the present invention indicated superior seizure resistance.

EMBODIMENT 3

Figure 4:
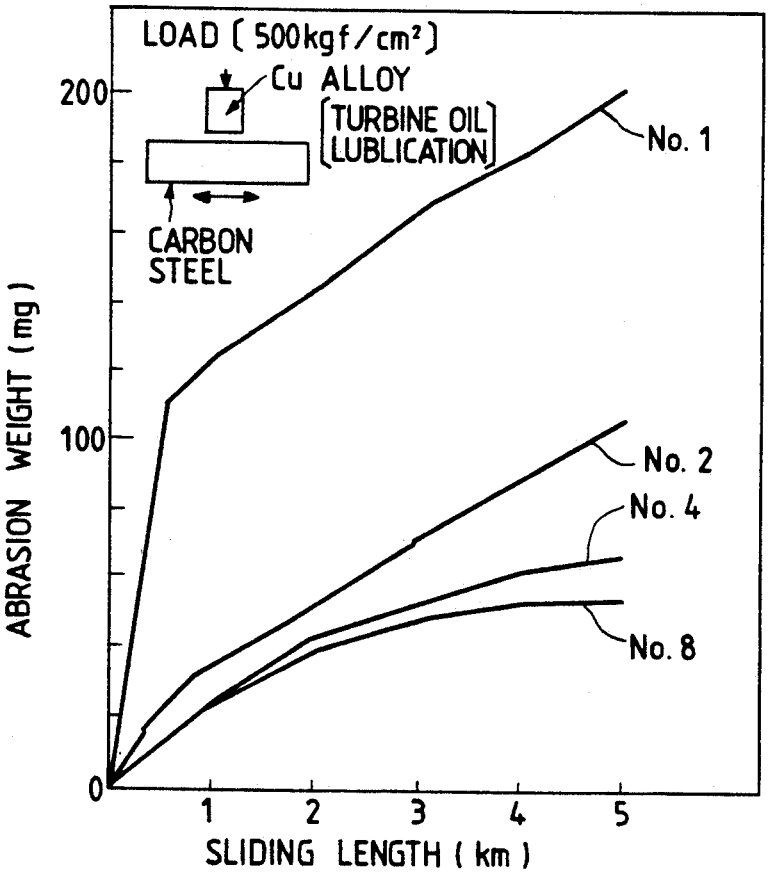
FIG. 4 is a graph showing the relation between sliding length and quantity of abrasion obtained by abrasion resistance tests in oil.

In FIG. 4, abrasion resistance of alloys in oil is shown.

For the measurement of the above abrasion resistance, a cylindrical fixed specimen of 10 mm diameter×25 mm long was prepared with copper alloys, the specimen was pushed onto a movable specimen made from carbon steel (JIS S45C) of 120 mm×15 mm×10 mm, reciprocating motion of the movable specimen was performed in turbine lubricating oil, and amount of the alloys abrasion per friction length was measured. Facing pressure was 500 kgf/cm², and sliding speed was 0.2 m/s.

Abrasion resistance of the aluminum bronze alloy (No. 4 and No. 8) relating to the present invention wherein Mn-Si compound were dispersed were far superior to the abrasion resistance of conventional aluminum bronze alloy (No. 1) and abrasion resistant high strength brass alloy (No. 2). As for sliding members, if wearing of paired sliding member can be decreased, the operating life of the sliding members can be extended. It was revealed that abrasion amount of paired sliding member with alloy No. 1, a comparative example, was 10 mg per 5 km of friction distance, but the abrasion amount with No. 4 and No. 8 of the present embodiments were remarkably decreased such as to about ½ of the No. 1 for No. 4, and to about 1/5 for No. 8.

EMBODIMENT 4

Next, a concrete example of application of the alloys relating to the present invention is explained.

Figure 5:
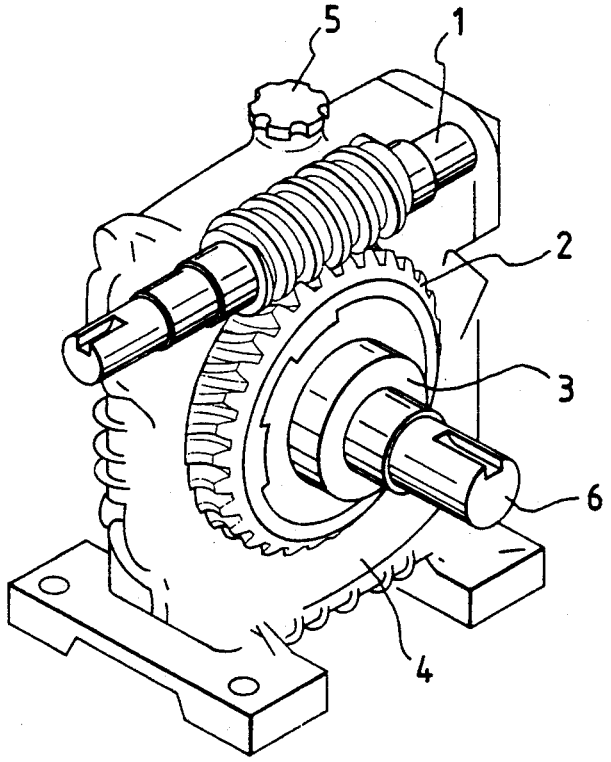
FIG. 5 is a partial cross sectional perspective view of a reducer wherein the alloy obtained by the present invention is applied.

FIG. 5 is a partially cross sectional perspective view of a reducer indicating structure of the reducer using the alloy relating to the present invention. As FIG. 5 indicates, main component of the reducer is a meshed portion of gears of the worm 1 and worm wheel 2. The wheel boss 3 is attached to the worm wheel 2, and farther the wheel axis 6 is attached.

A performance test was executed on a combination that the alloy relating to the present invention was applied to the gear of the worm wheel 2 and carburized case hardening steel (JIS SCM 415) was applied to the gear of the worm 1. The result was that the amount of abrasion was less than a half in comparison with the amount of abrasion of conventional high strength brass and aluminum bronze which were used as comparative examples. Consequently, it was revealed that the alloy relating to the present invention is remarkably superior in abrasion resistance. Farther, in consideration that performance of the reducer is proportional to size of the gear, a performance test was executed on the gear of the worm wheel 2 made from the alloy relating to the present invention, of which diameter was changed from 100 mm to 500 mm. The result was that the amount of abrasion was small as same as the above described case, and superior seizure resistance was also confirmed.

In the above described case, the worm wheel is manufactured advantageously in cost by casting with the wheel boss 3 as a core and a mold wherein the alloy of the worm wheel 2 is attached at external circumference, so-called wrapping cast method.

EMBODIMENT 5

Figure 6:
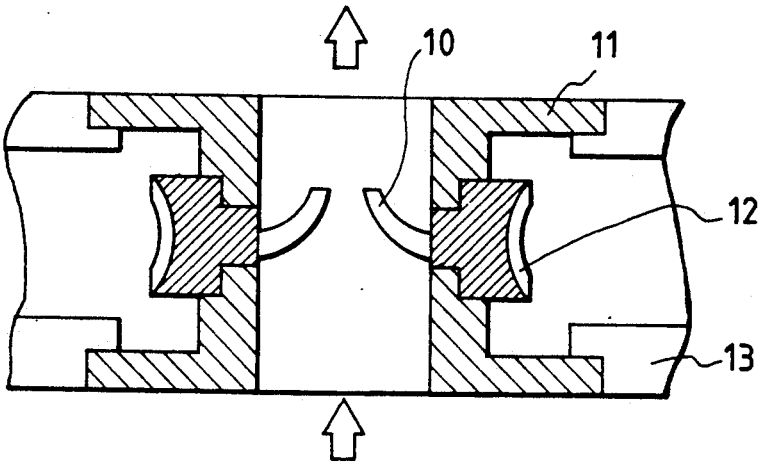
FIG. 6 is a view of vertical cross section of a sliding member wherein the alloy obtained by the present invention is applied.

FIG. 6 is a vertical cross section of main members of a bun manufacturing machine. The members are composed of the blade 10 attached to the worm wheel 12, the guide metal 11, and the table 13. Kneaded powder of raw material for the bun is extruded toward the arrow direction by rotation of the worm wheel 12. At that time, the guide metal 11 (fixed) and the worm wheel 12 (movable) are in face contact without lubricant. In a conventional bun manufacturing machine, bearing steel (JIS SUJ-2) has been used for the worm wheel 12 and aluminum bronze (JIS A1BC-2) has been used for the guide metal 11. But, on account of generation of seizure at contact face of the worm wheel 12 and the guide metal 1, using life of the members was almost 8–48 hours. But the using life could be improved to more than 250 hours by applying of the alloy relating to the present invention.

Food manufacturing machines such as the above described bun manufacturing machine are restricted in using lubricating oil or lubricants. Farther, contamination with abrasion powder of sliding members must be avoided. In the above described point of view, the alloy relating to the present invention is preferable material because of having superior characteristics without lubricants.

EMBODIMENT 6

Next, an embodiment of manufacturing method of forging and extruding material of the alloy relating to the present invention is explained.

First, the alloy relating to the present invention was melted by a routine method, and mold casted material having 350 mm in diameter and 250 mm long was obtained.

The mold casted material was heated at 850° C. for 3 hours, subsequently was forged at 680°–880° C. to form a forging material having 220 mm in diameter and forging ratio of 2.5. From the forging material, an extruding raw material having 200 mm in diameter and 600 mm long was prepared and extruded. The extruding temperature was 850°–860° C. and the extruding pressure was 110–280 kgf/cm$^2$, and a rod-shaped extruded material of 26 mm in diameter was prepared. In the above described manufactured materials, Mn-Si compound was divided finely, but the same abrasion resistance as casting material was obtained.

What is claimed is:

1. An abrasion resistant aluminum bronze alloy consisting of
Al: 7–12%,
Mn: 1.5–5.5%,
Si: 0.45–2.7%, respectively in weight, and the rest is substantially Cu, of which Mn/Si ratio is 1–3.25, and
elongation percentage is at least 5%.

2. An abrasion resistant aluminum bronze alloy consisting of
Al: 7–12%,
Mn: 1.5–5.5%,
Si: 0.45–2.7%,
Zn: at most 2%,
Pb: at most 1%,
at least one of Cr, V, Ti, and Zr: at most 1% in total, respectively in weight, and
the rest is substantially Cu, of which Mn/Si ratio is 1–3.25.

3. An abrasion resistant aluminum bronze alloy consisting of
Al: 7–12%,
Mn: 3.8–5.4%,
Si: 0.45–2.7%,
Zn: at most 2%,
Pb: at most 1%,
at least one of Cr, V, Ti, and Zr: at most 1% in total, respectively in weight, and
the rest is substantially Cu, of which Mn/Si ratio is 1–3.25.

4. A sliding member, which slides with a sliding portion made from steel material for industrial apparatus, composed from abrasion resistant aluminum bronze alloy consisting of
Al: 7–12%,
Mn: 1.5–5.5%,
Si: 0.45–2.7%, respectively in weight, and
the rest is substantially Cu, wherein Mn/Si ratio is 1–3.25 and metallic compound of Mn and Si is dispersed among said alloy structure.

5. A sliding member, which slides with a sliding portion made from steel material for industrial apparatus, composed from abrasion resistant aluminum bronze alloy consisting of
Al: 7–12%,
Mn: 3.8–5.4%,
Si: 0.45–2.7%, respectively in weight, and
the rest is substantially Cu, wherein Mn/Si ratio is 1–3.25 metallic compound of Mn and Si is dispersed among said alloy structure, and
elongation percentage is at least 5%.

6. An abrasion resistant aluminum bronze alloy according to claim 1, wherein the Mn/Si ratio is 2.0–3.0.

7. An abrasion resistant aluminum bronze alloy according to claim 2, wherein the Mn/Si ratio is 2.0–3.0.

8. An abrasion resistant aluminum bronze alloy according to claim 3, wherein the Mn/Si ratio is 2.0–3.0.

9. A sliding member according to claim 4, wherein the Mn/Si ratio is 2.0–3.0.

10. A sliding member according to claim 5, wherein the Mn/Si ratio is 2.0–3.0.

* * * * *